US005979075A

United States Patent [19]

Grenci et al.

[11] Patent Number: 5,979,075

[45] Date of Patent: Nov. 9, 1999

[54] HEAT GENERATION THROUGH MECHANICAL MOLECULAR GAS AGITATION

[76] Inventors: Charles Grenci, 205 Brown Rd., Montrose, Colo. 81401; R. Dallas Clayton, 501 Alvarado Dr. NE., Albuquerque, N.Mex. 87108

[21] Appl. No.: 09/246,868

[22] Filed: Feb. 8, 1999

Related U.S. Application Data

[62] Division of application No. 08/877,981, Jun. 18, 1997, Pat. No. 5,906,055, which is a continuation of application No. 08/092,778, Jul. 19, 1993, Pat. No. 5,678,759.

[51] Int. Cl.[6] ..... F26B 5/04

[52] U.S. Cl. ..... 34/410; 34/92; 126/247; 237/1 R

[58] Field of Search ..... 34/92, 219, 412, 34/406, 410; 237/1 R; 126/247

[56] References Cited

U.S. PATENT DOCUMENTS 5,341,768 8/1994 Pope ..... 122/26
5,439,358 8/1995 Weinbrecht ..... 418/15

*Primary Examiner*—Henry Bennett
*Assistant Examiner*—Pamela A. Wilson

[57] ABSTRACT

Specifically configured dual rotor, multi-lobed, rotary gas compressors in a piping system will provide clean gas heating and re-circulation that will quickly and efficiently heat a connected process chamber or process piping section. Substantial heat is quickly generated through mechanical agitation of the gas molecules that pass through the inlet and outlet of a dual rotor, multi-lobed, rotary gas compressor. The invention application of a dual rotor, multi-lobed, rotary gas compressor as a means of imparting heat to a gas stream provides an economical source of convective heat for closed and open loop piping applications.

9 Claims, 9 Drawing Sheets

HEAT GENERATION THROUGH MECHANICAL MOLECULAR GAS AGITATION

CROSS REFERENCE TO RELATED APPLICATION

This is a divisional of application Ser. No. 08/877,981 filed on Jun. 18, 1997 now U.S. Pat. No. 5,906,055 which is a continuation of application Ser. No. 08/092,778, filed on Jul. 19, 1993 now U.S. Pat. No. 5,678,759.

BACKGROUND OF THE INVENTION

The present invention is directed to the discovery of a clean, gas heating and re-circulating pumping system configuration that will quickly and efficiently heat a connected process chamber or process piping section. The useful application of the invention includes the removal of stubborn contaminants such as water vapor and hydrocarbons from the internal surfaces of a process vacuum chamber or process piping system. The invention utilizes the substantial heat generated and subsequently imparted to gas molecules that are agitated as they pass through the inlet and outlet of a dual rotor, multi-lobed, rotary gas compressor. There are a variety of dual rotor, multi-lobed, rotary gas compressors that will perform the gas agitation/heating function of the invention, the most common being dual rotor, multi-lobed, rotary gas compressors such as roots or screw type pumps. The invention was developed using a dual rotor, 60 degree twist, three-lobe rotor, rotary gas compressor, although it is envisioned that there may be alternative pump geometries that will perform the invention functions even more efficiently. The invention heat generation through mechanical molecular gas agitation functions are: 1) Rapid agitation of gas molecules that pass through the inlet and outlet of the compressor/pump creating a substantial rise in gas temperature; 2) Rapid gas throughput to increase the frequency that the gas is agitated in a closed loop gas re-circulation system; 3) Rapid gas agitation and subsequent gas temperature rise with a minimal delta pressure compression ratio between the compressor inlet and exhaust to minimize the amount of energy required to drive the compressor; 4) The ability to operate over a wide pressure range to cover both positive and vacuum pressure applications. The use of dual rotor, multi-lobed, rotary gas compressor to quickly and efficiently raise gas temperature will have broad application as an economical source of convective heat in closed loop piping, commercial convection ovens, process vacuum systems, positive/vacuum pressure dehydration applications, and water and space heating.

BACKGROUND ART

In order to generate convection heat, industry has relied on contact of a gas medium with a hot surface or flame. The heat imparted to the gas medium in this type of configuration is directly proportional to the amount of energy consumed to maintain the elevated temperature of the surface or the temperature of the flame that is in direct contact with the gas stream. Conversely, convection or gas contact heat has not been an energy efficient method to transfer heat to a surface due to the poor thermal transfer capability of gas in this type of heating configuration, although in special applications, such as the removal of certain types of contaminants such as molecular water vapor and hydrocarbon molecules from the internal surfaces of a vacuum system, cycle purging with a heated purge gas has been an efficient method. The most common method to remove the contamination has been the energy intensive application of external heat to the vacuum process chamber. This external heat baking to elevated temperatures as high as 400 degrees Fahrenheit is used in vacuum systems to reduce the dwell time of contaminants on the internal surfaces of a process system. The external baking is not always enough to provide successful removal of the contamination. When conventional configurations rely on vacuum to remove the contamination; the random motion of this molecular contamination in molecular flow vacuum conditions makes successful removal primarily a function of time. A successful prior art technique to reduce this time has been the introduction of a hot gas purge to sweep the inside surfaces of molecular contamination with a hot dry gas that will act as an effective transport mechanism for the contamination to the vacuum pumping subsystem. The effectiveness of the heated gas purge is improved through repeated purge cycles. In attempts to find a more efficient method to perform this hot gas purge function, it has been discovered the heat generation method of the invention, using a dual rotor, multi-lobed, rotary gas compressor to perform the molecular gas agitation function that can very quickly impart heat to a gas stream more efficiently than traditional methods that utilize contact with a hot surface.

SUMMARY OF THE INVENTION

It has been discovered that certain dual rotor, multi-lobed, rotary gas compressors can impart a significant amount of heat to the gas molecules that pass from the inlet of the pump to the outlet. The addition of a gas recirculation valve makes it possible to quickly and efficiently impart heat to a gas stream as it is recirculated through the compressor. When this is connected to a process vacuum chamber at a process vacuum chamber, evacuation port and recirculation port, the heat generated by a dual rotor, multi-lobed, rotary gas compressor quickly elevates the temperature of a purge gas as it flows from the compressor inlet to the compressor outlet through the process vacuum chamber and associated system piping in a re-circulating fashion that sweeps the internal surfaces of the system with hot purge gas to provide rapid removal of contamination from the internal surfaces of the vacuum system, so that it can be effectively pumped away by the vacuum pump subsystem. It has been found that dual rotor-gas boosters will impart a great deal of heat energy to the gas molecules that pass through the booster through the control of three basic parameters: a) the gas pressure/molecular density inside the pump; b) increasing the dwell time of the molecules inside the pumping mechanism by restricting the flow of gas at either the pump inlet, the pump outlet or both; c) the frequency that the gas molecules pass through the pumping mechanism in the re-circulation operation. It should be noted that these parameters are easily controlled and that the pump-application performs the molecular gas agitation/heat generation, hot gas stream re-circulation and system evacuation functions as a single component in a simple system configuration. This simple re-circulation configuration, through the adjustment of these parameters, may prove to be a more efficient and economical source of heat generation than re-circulated hot water or air that is heated through contact with an electrical resistance heated surface.

BRIEF DESCRIPTION OF THE DRAWINGS

Reference is had to the accompanying drawings, which are not to be construed as limiting the invention, wherein.

DESCRIPTION OF THE PREFERRED EMBODIMENTS

Figure 1:
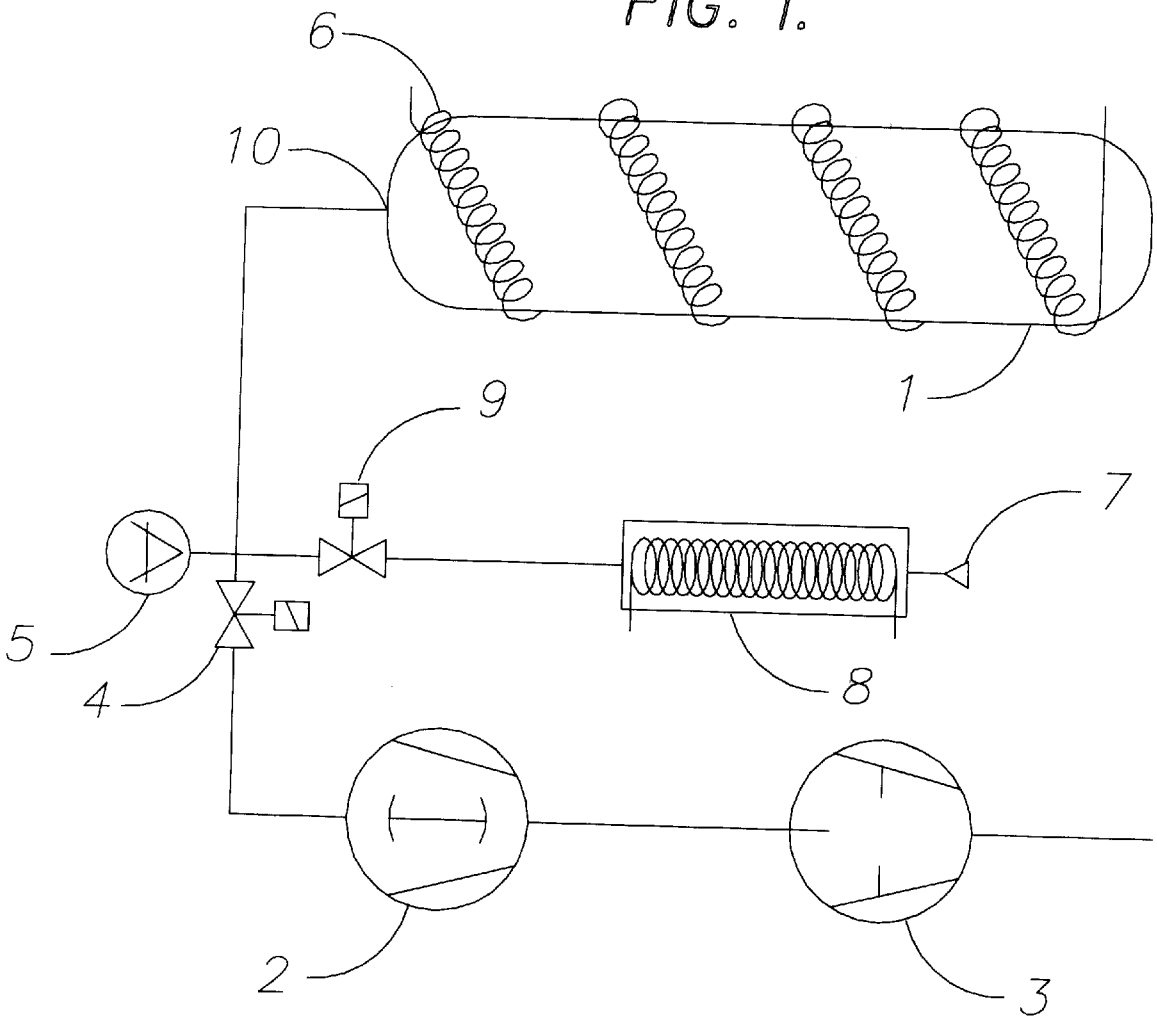
FIG. 1 is a schematic of a typical prior art, medium vacuum pumping configuration to remove internal surface contamination.

Referring to FIG. 1, a typical, prior art, medium vacuum pressure system that is externally heated and internally purged with hot gas is shown to illustrate the components that are used in the construction of prior-art systems that are designed to remove internal surface contamination from the process vacuum chamber and associated pipe work. The illustration of the system is intended to aid in understanding of the present invention. The prior art system example comprises a process vacuum chamber 1 that is heated by an external electric baking jacket 6. The process vacuum chamber 1 is connected to a two stage, medium vacuum pressure pumping subsystem. The example subsystem comprises a first stage rough vacuum pump 3, and a second stage dual rotor, multi-lobed, rotary gas compressor 2. The subsystem is connected to the process vacuum chamber 1 by a piping manifold that includes a vacuum gauge sensor 5 to measure the total vacuum pressure level achieved by the first and second stage vacuum pumps, a second stage medium vacuum pressure isolation valve 4, and a purge gas inlet valve 9. In addition to the external electric baking jacket 6, the system configuration includes an electric purge gas heater 8 that will elevate the temperature of the purge gas 7 to further assist the removal of contamination from the internal surfaces of the example vacuum system. The application of external heat is intended to desorb molecular level contamination from the internal surfaces of the vacuum system so that they can be pumped by the vacuum pumping subsystem. The most common and persistent type of contamination in vacuum applications is molecular water vapor. This type of contamination is very difficult to remove by vacuum pumping. To better remove water vapor contamination the addition of the hot gas purge will help to sweep the inside surfaces of molecular water vapor with a hot dry gas that will act as an effective transport mechanism of the water vapor contamination to the vacuum pumping subsystem. The effectiveness of the heated gas purge is improved through repeated purge cycles.

Figure 2:
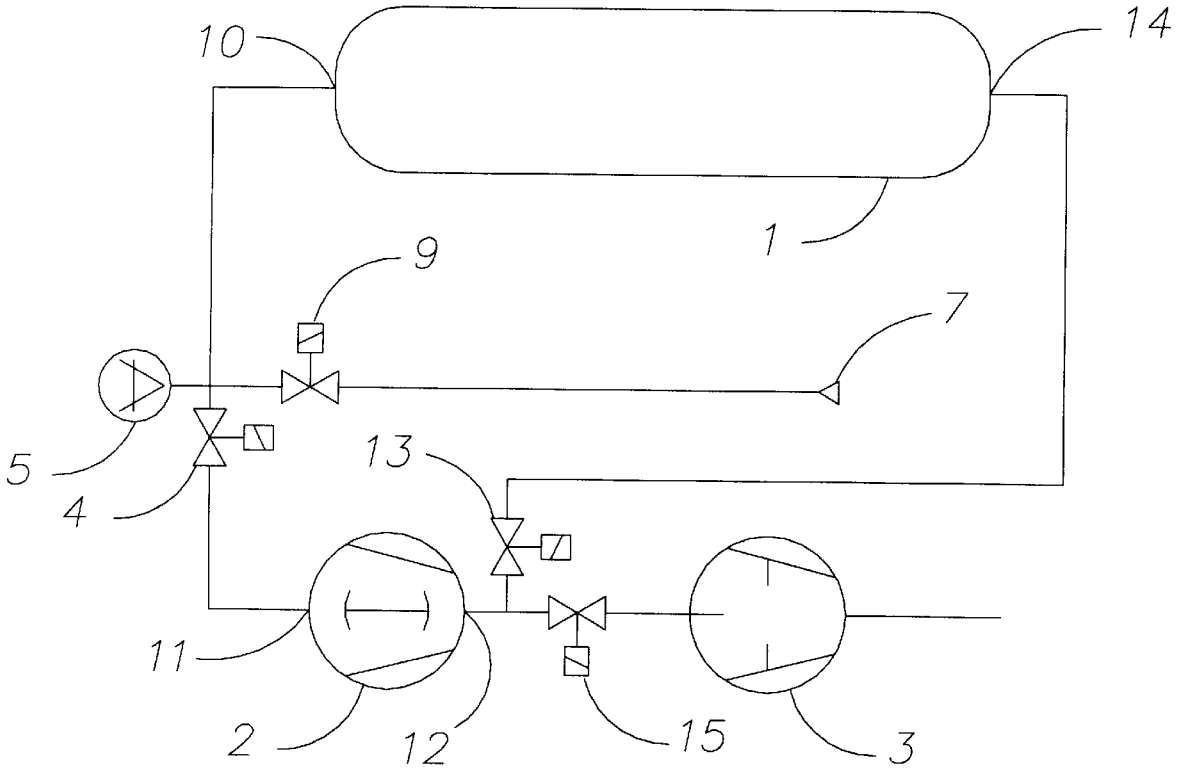
FIG. 2 is a medium vacuum system that incorporates the gas re-circulation method of the invention to remove internal surface contamination.

Referring to FIG. 2, a medium vacuum pressure system that has been modified with the gas re-circulation configuration of the invention is shown to illustrate the components that are used in the construction of a vacuum system that utilizes the present invention to remove internal surface contamination from the process vacuum chamber and associated pipe work. The system of the invention comprises a process vacuum chamber 1 that is connected to a two stage, medium vacuum pressure pumping subsystem. The example subsystem comprises a first stage rough vacuum pump 3, and a second stage dual rotor, multi-lobed, rotary gas compressor 2. The subsystem is connected to the process vacuum chamber 1 by a piping manifold, that includes a vacuum gauge sensor 5 to measure the total vacuum pressure level achieved by the first and second stage vacuum pumps, a second stage medium vacuum pressure isolation valve 4, and a purge gas inlet valve 9. The addition of a gas re-circulation valve 13, connected to the process vacuum chamber 1 at the process vacuum chamber re-circulation port 14, and a first stage rough vacuum isolation valve 15 provides the ability to utilize the heat generated by the second stage dual rotor, multi-lobed, rotary gas compressor 2 to elevate the temperature of the purge gas 7 as it flows from the vacuum compressor inlet 11 to the vacuum compressor outlet 12 through the process vacuum chamber 1 and associated system piping in a re-circulating fashion that sweeps the internal surfaces of the system with hot dry purge gas to provide rapid removal of contamination from the internal surfaces of the example invention vacuum system so that it can be effectively pumped away by the vacuum subsystem.

Figure 3:
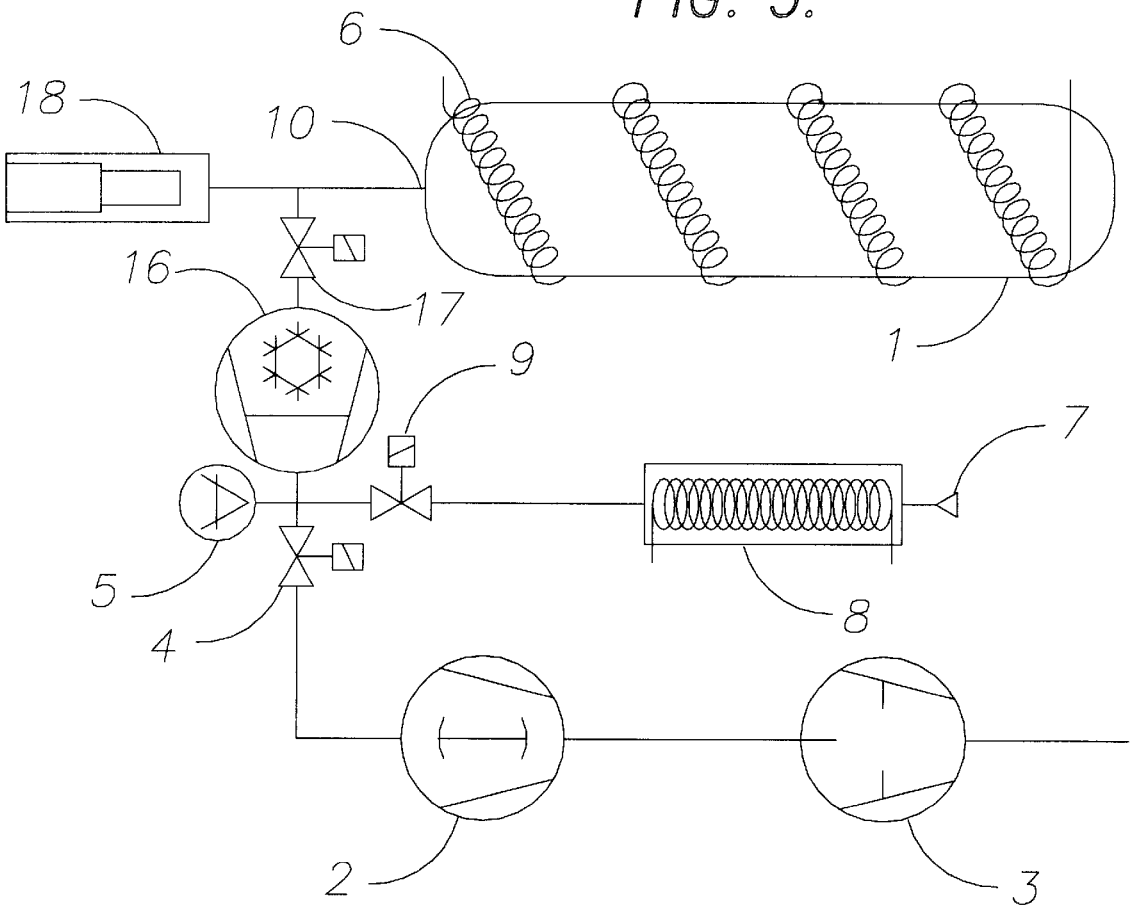
FIG. 3 is a schematic of a prior art, high vacuum pumping configuration to remove internal surface contamination.

Referring to FIG. 3, a typical, prior art, high vacuum pressure system that is externally heated and internally purged with hot gas, is shown to illustrate the basic components that are used in the construction of prior art systems that are designed to remove internal surface contamination from the process vacuum chamber and associated pipe work. The illustration of the system is intended to aid understanding of the present invention. The prior art system example comprises process vacuum chamber 1 that is heated by an external electric baking jacket 6. The process vacuum chamber 1 is connected to a three stage, high vacuum pressure pumping subsystem. The example subsystem comprises a first stage rough vacuum pump 3, a second stage dual rotor, multi-lobed, rotary gas compressor 2 and a high vacuum cryogenic capture pump 16. The subsystem is connected to the process vacuum chamber 1 by a piping manifold, that includes a residual gas analysis sensor 18 to measure partial vacuum pressure contamination levels and to measure the total vacuum pressure achieved by the high vacuum cryogenic capture pump 16, a third stage high vacuum isolation valve 17, a vacuum gauge sensor 5 to measure the total vacuum pressure level achieved by the first and second stage vacuum pumps, a second stage medium vacuum pressure isolation valve 4, and a purge gas inlet valve 9. In addition to the external electric baking jacket 6, the system configuration includes an electric purge gas heater 8 that will elevate the temperature of the purge gas 7 to further assist the removal of contamination from the internal surfaces of the example vacuum system. The application of external heat is intended to desorb molecular level contamination from the internal surfaces of the vacuum system so that they can be pumped by the vacuum pumping subsystem. The most common and persistent type of contamination in vacuum applications is molecular water vapor. This type of contamination is very difficult to remove by vacuum pumping. Although the cryogenic type pump used in this example is the most efficient pump for this purpose, it is difficult in many systems to transport the water vapor to the pump efficiently. To better remove water vapor contamination, the addition of the hot gas purge will help to sweep the inside surfaces of molecular water vapor with a hot dry gas that will act as an effective transport mechanism for the water vapor contamination to the vacuum pumping subsystem. The effectiveness of the heated gas purge is improved through repeated purge cycles.

Figure 4:
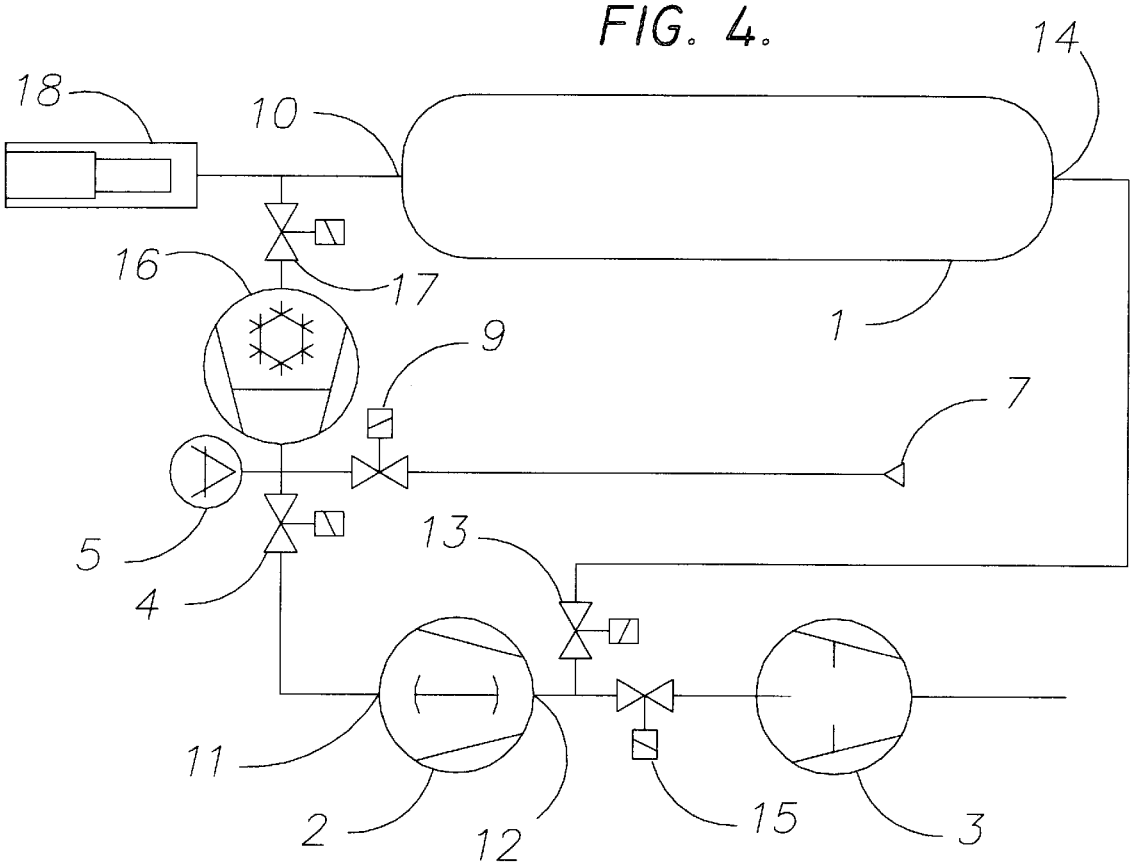
FIG. 4 is the high vacuum system of FIG. 3 that has been modified to incorporate the gas recirculation method of the invention to remove internal surface contamination.

Referring to FIG. 4, a high vacuum pressure system that has been modified with the gas re-circulation configuration of the invention is shown to illustrate the components that are used in the construction of a vacuum system that utilizes the present invention to remove internal surface contamination from the process vacuum chamber and associated pipe work. The example of the invention comprises a process vacuum chamber 1 that is connected to a three stage, high vacuum pressure pumping subsystem. The example subsystem comprises a first stage rough vacuum pump 3, a second stage dual rotor, multi-lobed, rotary gas compressor 2, and a high vacuum cryogenic capture pump 16. The subsystem is connected to the process vacuum chamber 1 by a piping manifold, that includes a residual gas analysis sensor 18 to measure partial vacuum pressure contamination levels, a third stage high vacuum isolation valve 17, a vacuum gauge sensor 5, to measure the total vacuum pressure level achieved by the first and second stage vacuum pumps, a second stage medium vacuum pressure isolation valve 4, and a purge gas inlet valve 9. The addition of a gas re-circulation valve 13, connected to the process vacuum chamber 1 at the process vacuum chamber re-circulation port 14, and a first stage rough vacuum isolation valve 15 provides the ability to utilize the heat generated by the second stage dual rotor, multi-lobed, rotary gas compressor 2 to elevate the temperature of the purge gas 7 as it flows from the vacuum compressor inlet 11 to the vacuum compressor outlet 12 through the process vacuum chamber 1 and associated system piping in a re-circulating fashion that sweeps the internal surfaces of the system with hot dry purge gas to provide rapid removal of contamination from the internal surfaces of the vacuum system, so that it can be effectively pumped away by the vacuum subsystem. In this configuration, the re-circulated gas acts as an efficient transport mechanism for molecular water vapor contamination that is then easily condensed and trapped by the ultra cold surfaces of the cryogenic pump.

Figure 5:
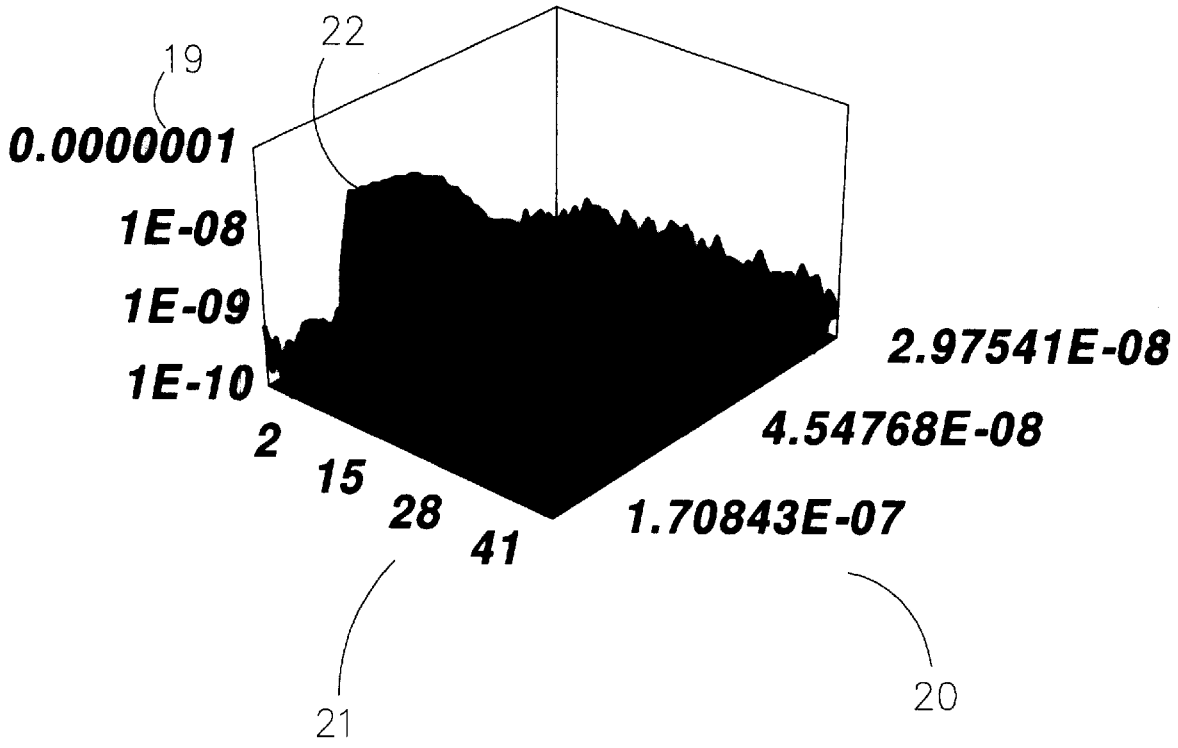
FIG. 5 is a three dimensional surface, residual gas analysis chart that shows a quick reduction of background water vapor contamination in a high vacuum chamber using the gas re-circulation vacuum pumping system of the invention.

Referring to FIG. 5, a three dimensional surface, residual gas analysis chart is shown that is comprised of a partial vacuum pressure in Torr units—A scale 19, a total vacuum pressure in Torr units—X scale 20, and an Atomic Mass units—Y scale 21. The data shows a 45,000% improvement in the partial pressure level readings for Atomic Mass Unit 18—H20 vapor molecules 22. This data was gathered by connecting a high vacuum pumping system that was configured as shown in FIG. 4, to a complex shaped high vacuum piping system containing 11 ea. 4" diameter straight sections 67 in length, 32 ea. 4" elbows, 18 ea. 4" diameter straight sections 83 in length, 12 ea. 4" crosses, and 40 ea. 4" diameter straight sections 4" in length. The total internal volume of the piping system was 23.6 cubic feet, and the total internal surface area equaled 283 square feet. The piping system was evacuated to 0.003 Torr using a Nuvac model NDP-70 two stage oil free pumping system serial number 022292 modified as shown in FIG. 4 by opening both the third stage high vacuum isolation valve and the second stage medium vacuum pressure isolation valve. The second stage isolation valve was then closed and the purge valve was opened until the vacuum pressure in the piping system reached 600 Torr. The second stage isolation valve was then opened until the piping system was evacuated to 400 Torr, at which point the first stage isolation valve was closed and the gas recirculation valve was opened. The gas inside the piping system was re-circulated for 5 minutes which elevated the temperature of the gas to 200 degrees F. The first stage rough vacuum isolation valve was then opened until the pressure in the piping system reached 0.01 Torr, at which point the CTI On—board 8, cryogenic capture pump serial number AD119939 compressor was started and subsequent cool down of the cryogenic pump began. Gas molecules were recirculated by the second stage dual rotor, multi-lobed, rotary gas compressor until the temperature of cryogenic capture pump reached 50 degrees Kelvin at which point the second stage medium pressure isolation valve and the gas recirculation valve were closed. When the cryogenic capture pump reached its base temperature of 10 degrees Kelvin, the RGA emissions were turned on and the RGA was allowed to warm up for 20 minutes. The data set in this Figure shows the spectral data gathered for the next 1.5 hours. The RGA used to collect this data was an MKS model number 600A PPT, serial number 1251-9201.

Figure 6:
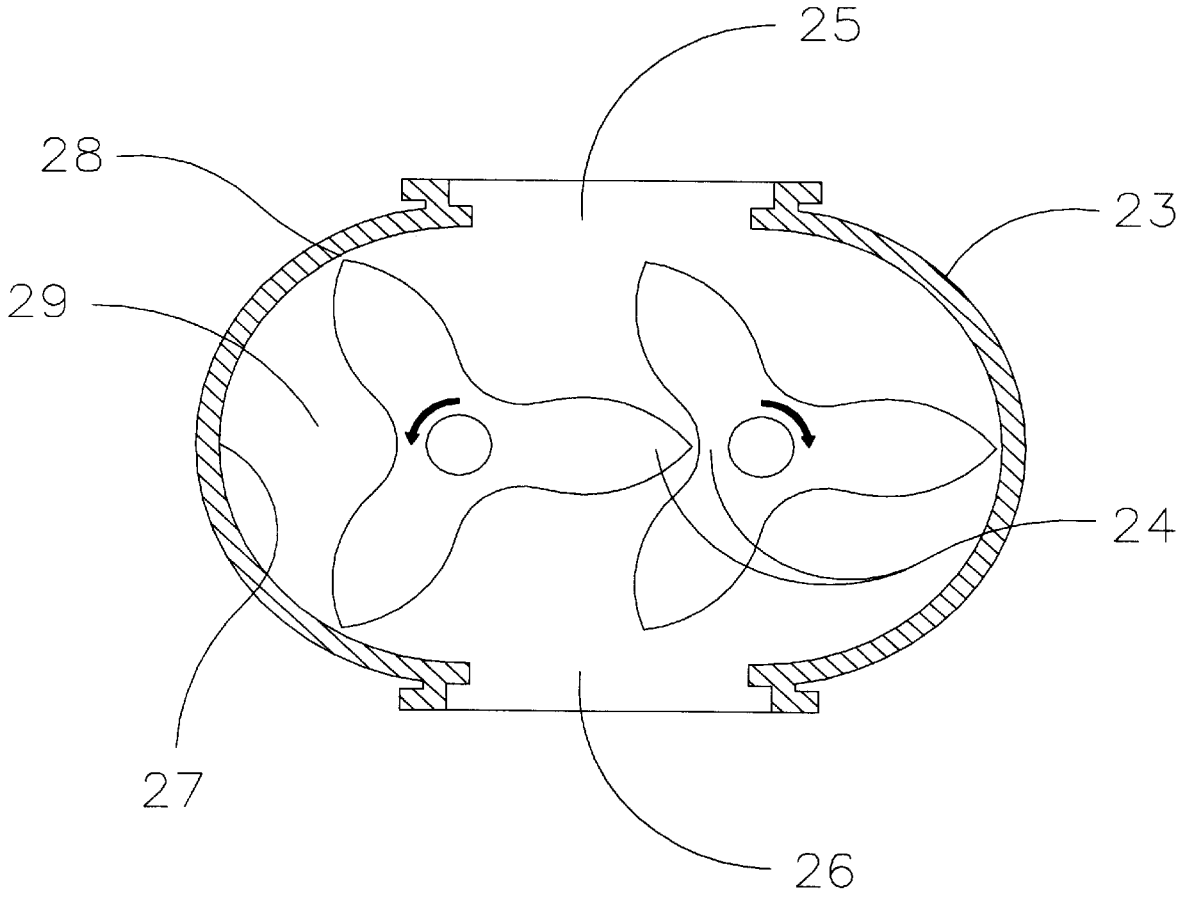
FIG. 6 is a cutaway view of a dual rotor, multi-lobed, rotary gas compressor to illustrate how the operation of this type of pumping mechanism imparts heat to the gas molecules that pass through the pump.

Referring to FIG. 6, a cutaway view of a dual rotor, multi-lobed, rotary gas compressor 23 is shown to illustrate how this type of pump imparts heat to the gas molecules that enter the compressor inlet 25 and are then trapped in a gas pocket 29 formed between the rotor lobes tips 28 and the pump stator inside diameter 27. As the synchronized rotors travel in opposite directions, the formed gas pockets are expelled at the compressor outlet 26. The close tolerance, intermeshing relationship of the rotor tips and opposite rotor valleys 24 and the pump stator inside diameter 27, prevents significant leakage of gas molecules from the compressor outlet 26 and the compressor inlet 25 yet creates significant agitation of the gas molecules inside the pump. It has been found that this type of pumping mechanism can impart a great deal of heat energy to the gas molecules that pass through the mechanism by controlling three basic parameters: a) the gas pressure/molecular density inside the pump; b) increasing the dwell time of the molecules inside the pumping mechanism by restricting the flow of gas at either the pump inlet, the pump outlet or both; and c) the frequency that the gas molecules pass through the pumping mechanism in re-circulation operation. It should be noted that these parameters are easily controlled and that the compressor performs the heat generation, hot gas molecule recirculation and evacuation functions as a single component in a simple system configuration. This simple recirculation configuration, through the adjustment of these parameters may prove to be a more efficient and/or economical source of heat in certain applications that recirculated hot water or air that is heated through contact with a hot surface.

Figure 7:
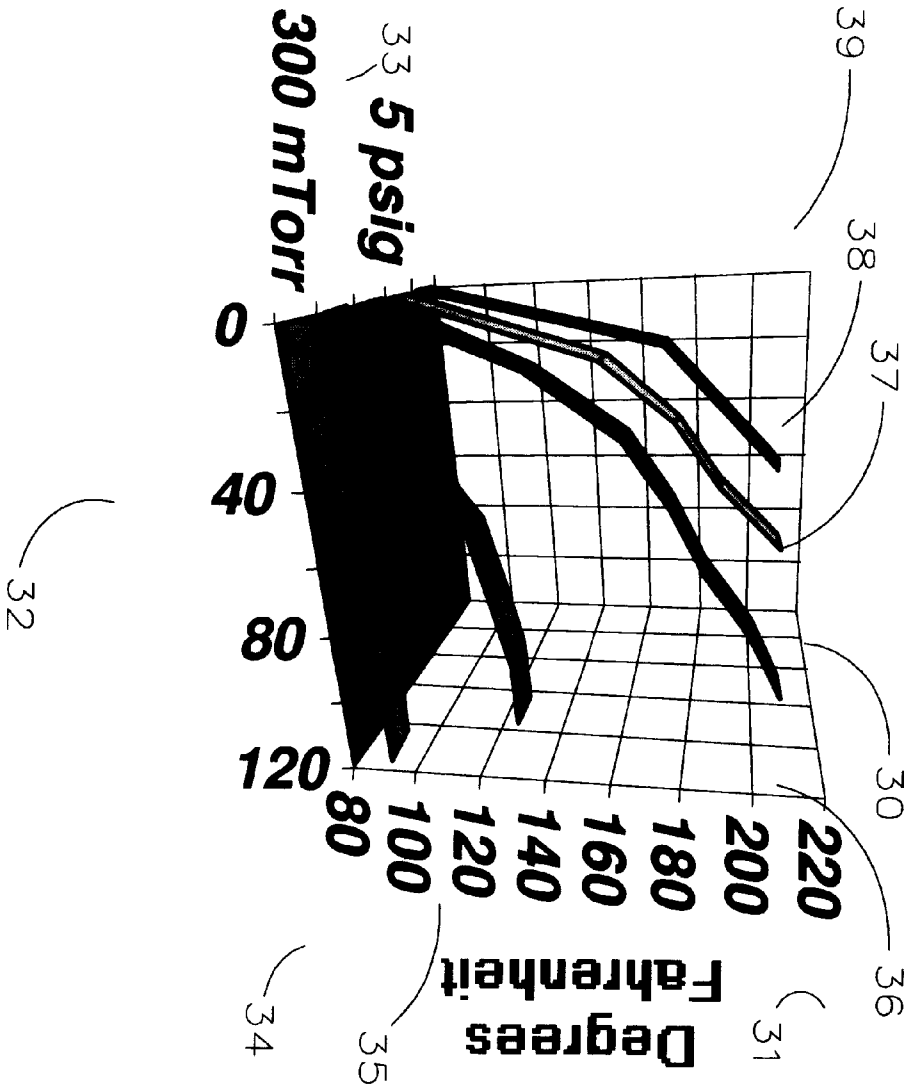
FIG. 7 is a three dimensional line graph that shows the effect of gas pressure/molecular density on the heat generation efficiency of the inventionm, this test being performed using the configuration shown in FIG. 2.

Referring to FIG. 7, a three dimensional line chart 30 is shown that is comprised of a gas Fahrenheit temperature Z scale 31, time in seconds X scale 32, and a compressor inlet gas pressure Y scale 33. The data set shows a 233% improvement in heat generation through mechanical molecular gas agitation between operation at 300 mTorr for 120 seconds 34 and operation at 10 psig for sixty seconds 39 or half the amount of time. In the comparison of these graph lines, it should be noted that operation at 300 mTorr consumed 5.5 amps of 440 volts 3 phase AC electrical power and operation at 10 psig consumed 8 amps of 440 volts 3 phase AC electrical power. Additional data points that cover gas Fahrenheit temperature versus time and pressure are: 300 Torr operation for 120 seconds 35; atmospheric pressure (640 Torr in the test location altitude) for 120 seconds 36; 5 psig operation for 120 seconds 37; and 10 psig for 20 seconds 39 are shown to further illustrate the relationship of gas molecular density to the heat generation potential of the invention. The electrical energy used at these pressures is 5.5 amps at 300 Torr, 6.5 amps at atmospheric pressure (640 Torr) and 7 amps at 5 psig. These energy requirements show a marked increase in the invention heat generation potential based on gas molecular density as a function of pressure, with a relatively small increase in energy consumption. This highly efficient relationship is due to the discovery that certain gas compressor geometries energy consumption is primarily a function of the delta pressure between the inlet and outlet without generating a high delta pressure. Furthermore, increasing the inlet gas pressure actually reduces the delta pressure ratio between the compressor inlet and outlet due to a shortened molecular mean free path which reduces the compression ratio efficiency. With the dual rotor, multi-lobed, rotary gas compressor geometry, a high inlet gas pressure/short molecular mean free path reduces the compression ratio efficiency of the compressor and creates a lower inlet/outlet delta pressure. When the dual rotor, multi-lobed, rotary gas compressor is operated in the re-circulating configuration, the reduced compression ratio efficiency and delta pressure relationship at higher inlet gas pressure helps to reduce the amount of energy required to operate the compressor at the higher pressure. The three dimensional line chart 30 in this Figure clearly shows that with the heat generation through mechanical molecular gas agitation of the invention, reduced compression ratio efficiency creates increased heat generation efficiency which indicates that the heat that is imparted to the gas stream is not due to basic heat of compression but rather the agitation of the gas molecules as they pass through the pump.

Figure 8:
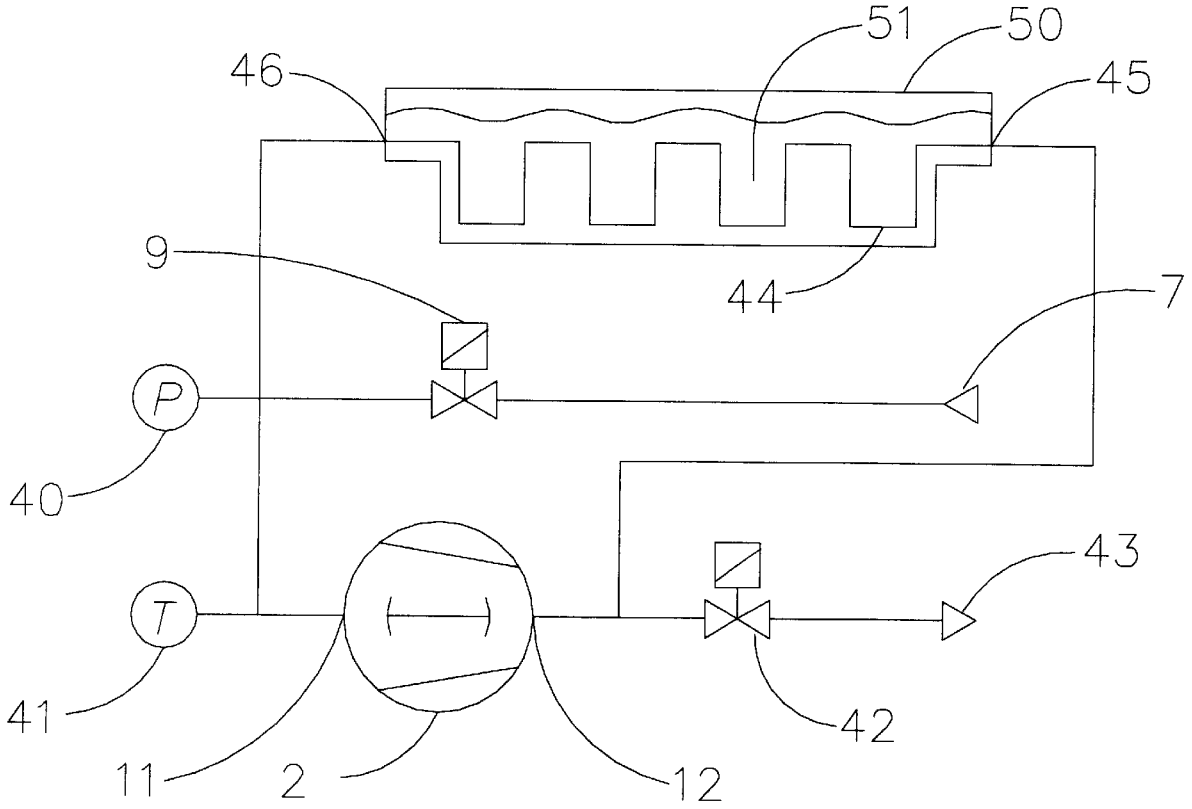
FIG. 8 is a schematic of the invention used to transfer heat to a fluid inside of a holding tank.

Referring to FIG. 8, a heat generation configuration of the invention to transfer heat to a process fluid 51 inside a process fluid container 50 is shown to illustrate use of the invention as an effective means of heat transfer to a liquid using a closed loop heat exchanger 44, that has a heat exchanger inlet 45 and heat exchanger outlet 46 for connection to gas re-circulation system of the invention. The gas re-circulation system example comprises a dual rotor, multi-lobed, rotary gas compressor 2 that is connected to the heat exchanger by a piping manifold, that includes a pressure gauge sensor 40 to measure recirculating gas inlet pressure, a purge gas inlet valve 9 to increase re-circulation gas pressure, a temperature gauge sensor 41 to measure re-circulating gas inlet temperature and purge gas outlet valve 42 to reduce re-circulation gas pressure. Operation of the dual rotor, multi-lobed, rotary gas compressor quickly elevates the temperature of the gas charge inside the piping of the purge gas 7 as it flows from the compressor inlet 11 to the compressor outlet 12 through the associated system piping in a re-circulation fashion that efficiently transfers heat to the process fluid 51. Heat generation in the example is simply controlled through adjustment of gas charge pressure, compressor operating speed, or both.

Figure 9:
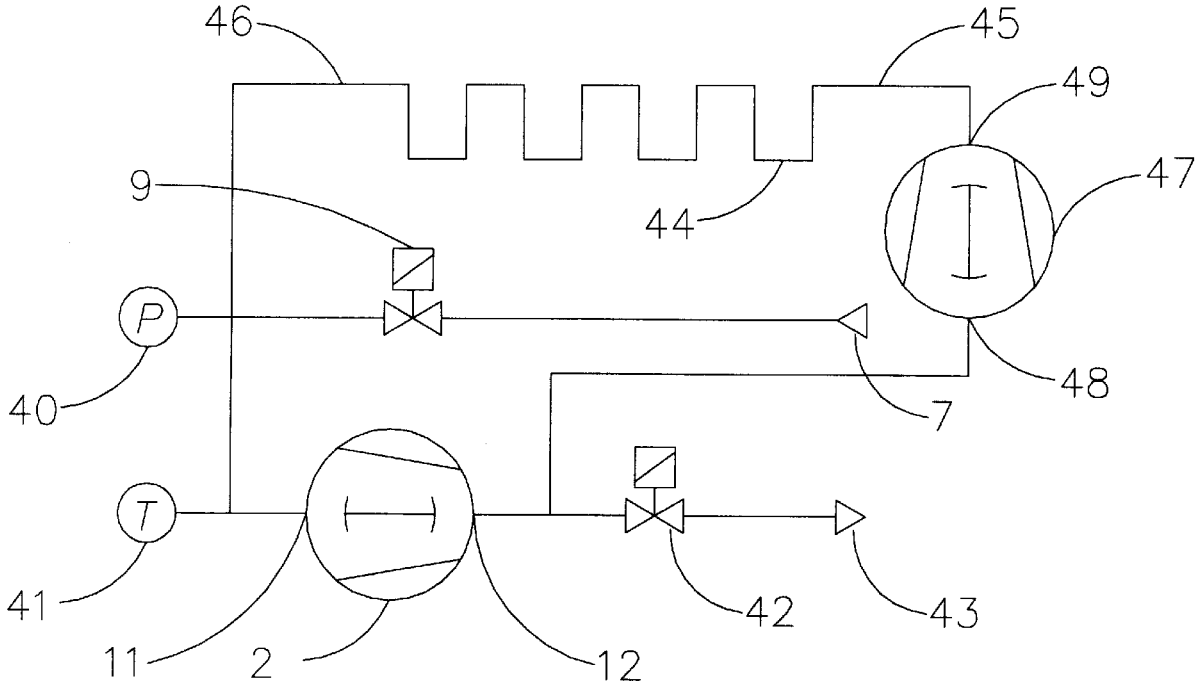
FIG. 9 is a schematic of the invention used to transfer heat to a space using multiple gas dual rotor, multi-lobed, rotary gas compressors in series to provide increased heat generation through increased frequency of gas stream recirculation/molecular gas agitation.

Referring to FIG. 9, the heat generation configuration to transfer heat to a space is shown to illustrate use of the invention as an effective means of this type of heat transfer. The gas re-circulation system example of the invention comprises a primary dual rotor, multi-lobed, rotary gas compressor 2, and a secondary dual rotor, multi-lobed, rotary gas compressor that are connected to the closed loop heat exchanger 44 at the heat exchanger inlet 45 and the heat exchanger outlet 46 by a piping manifold, that includes a pressure gauge sensor 40 to measure re-circulating gas inlet pressure, a purge gas inlet valve 9 to increase re-circulation gas pressure, a temperature gauge sensor 41 to measure re-circulating gas inlet temperature and purge gas outlet valve 42 to reduce recirculation gas pressure. Operation of the dual rotor, multi-lobed, rotary gas compressors quickly elevates the temperature of the gas charge inside the piping of the purge gas 7 as it flows from the primary compressor inlet 11 to the primary compressor outlet 12 and from the secondary compressor inlet to the secondary compressor outlet 49 through the associated system piping in a re-circulating fashion that efficiently transfers heat to the process fluid 51. Heat generation in the example is simply controlled through adjustment of gas charge pressure, compressor operating speeds, or both.

What we claim is:

1. A method of removal of contamination in an enclosed system by virtue of the re-circulation and sweep of a purge gas, comprising:

(a) passing a purge gas through at least one dual rotor, multi-lobed, rotary gas compressor through an inlet thereof to the outlet thereof:

(b) said step (a) comprising providing heat-generation to the gas through mechanical molecular agitation of gas molecules passing through at least one said rotary gas compressor;

(c) sweeping the heated gas through the enclosed system;

(d) said re-circulation and sweeping of the heated gas in the system breaking the forces that hold moisture and particles to chamber walls of the enclosed system, whereby moisture is desorbed into the gas and contaminant particles are entrained in the viscous gas flow;

(e) said step of sweeping contaminants by virtue of the system having a configuration with a physical geometry and a delta change in pressure;

(f) said step of sweeping introducing dry, dry gas into the re-circulation path while opening the viscous gas flow containing the contaminant particles to a vacuum, said physical geometry of the configuration having the heavier contaminated gas and particulates exhaust directly to the vacuum pump simply by virtue of taking the most direct straight path, said gas being exhausted directly out of the compressor into a conduit chamber where the straight path of the conduit chamber is connected to an open, vacuum isolation valve acting as a low-pressure straight-line exit for the contamination gas;

(g) filtering the purge gas so that the purge gas which has a high velocity is circulated and cleaned of captured contamination while returning clean purge gas to a process chamber.

2. A method of heating gas, comprising:

(a) passing a gas through at last one rotary gas compressor from the inlet thereof to the outlet thereof:

(b) said step (a) comprising providing heat-generation to the gas through mechanical molecular agitation of gas molecules passing through the at least one rotary gas compressor;

(c) said step (b) comprising controlling the following parameters of the at least one rotary gas compressor in order to enhance the heat-generation capability of the at least one rotary gas compressor: Controlling the gas pressure and molecular density inside the at least one rotary gas compressor from the inlet thereof to the outlet thereof; and controlling the amount of dwell-time of the gas molecules inside the at least one rotary gas compressor by restricting the flow of the gas at at least one of the inlet and outlet.

3. The method of heating gas according to claim 2, wherein said step (c) further comprises re-circulating the gas exiting from the outlet of the at least one rotary gas compressor through the at least one rotary gas compressor a plurality of times until the desired gas temperature of the gas from the outlet of the rotary gas compressor is attained.

4. The method of heating gas according to claim 2, wherein said step (c) further comprises minimizing the pressure differential between the inlet and the outlet of the at least one the rotary gas compressor in order to achieve heat generation with minimal energy consumption.

5. The method of heating gas according to claim 2, wherein said step (a) comprises operating the at least one rotary gas compressor at a pressure from between vacuum-pressure operation and positive-pressure operation.

6. The method of heating gas according to claim claim 2, further comprising:

(d) directing the heated exhaust gas exiting from the outlet of the at least one gas compressor to a location where the heat from the exhaust gas is used for performing work;

(e) returning the exhaust gas from the location where the heat performed work back to the inlet of the at least one gas compressor for re-heating the gas as it passes through the at least one gas compressor form the inlet thereof to the outlet thereof.

7. The method of heating gas according to claim 6, further comprising repeating said steps (d) and (e) a plurality of times, whereby the re-circulated exhaust gas is heated for each pass-through from the inlet to the outlet of the at leat one gas compressor.

8. A method of heating using a gas compressor system, which gas compressor system comprises a roots-type rotary gas compressor having an inlet and an outlet, said gas-compressor system comprising gas introducing means for introducing a gas, said method comprising:

(a) introducing gas into the gas compressor system until the desired volume has been introduced;

(b) directing the gas to the inlet of the roots-type rotary gas compressor so that the gas passes through the roots-type gas compressor;

(c) directing the gas exiting from the outlet of the rotary roots-type gas compressor to a location utilizing the heat thereof;

(d) said step (c) comprising preventing fluid communication between the outlet of the roots-type gas compressor and the exhaust of the gas compressor system;

said step (b) heating the gas;

wherein said step (c) comprises directing the gas exiting from the outlet of the rotary roots-type gas compressor along a conduit to the location where the heat from the exhaust gas is used.

9. The method of heating using a gas compressor system, according to claim 8, wherein said step (b) comprises directing the gas to the inlet of a dual rotor, multi-lobed, roots-type rotary compressor.

* * * * *